US010863266B2

(12) United States Patent
Kim et al.

(10) Patent No.: US 10,863,266 B2
(45) Date of Patent: Dec. 8, 2020

(54) HIGH-PRESSURE WATER RESISTANT MICROSPEAKER WITH IMPROVED COIL STRUCTURE

(71) Applicant: EM-TECH. Co., Ltd., Busan (KR)

(72) Inventors: Ji Hoon Kim, Gyeongsangnam-do (KR); Gang Tae Kim, Gyeongsangnam-do (KR); Jeong Seong Park, Gyeongsangnam-do (KR)

(73) Assignee: EM-TECH. CO., LTD., Busan (KR)

( * ) Notice: Subject to any disclaimer, the term of this patent is extended or adjusted under 35 U.S.C. 154(b) by 396 days.

(21) Appl. No.: 15/888,370

(22) Filed: Feb. 5, 2018

(65) Prior Publication Data

US 2018/0227667 A1 Aug. 9, 2018

(30) Foreign Application Priority Data

Feb. 6, 2017 (KR) ..... 10-2017-0016231

(51) Int. Cl.

| | |
|---|---|
| ***H04R 1/42*** | (2006.01) |
| ***H04R 9/04*** | (2006.01) |
| ***H04R 1/02*** | (2006.01) |
| ***H04R 9/02*** | (2006.01) |
| ***H04R 9/06*** | (2006.01) |
| ***H04R 1/44*** | (2006.01) |

(52) U.S. Cl.

CPC ..... *H04R 1/42* (2013.01); *H04R 9/046* (2013.01); *H04R 1/023* (2013.01); *H04R 1/44* (2013.01); *H04R 9/025* (2013.01); *H04R 9/06* (2013.01); *H04R 2400/11* (2013.01); *H04R 2499/11* (2013.01)

(58) Field of Classification Search

CPC . H04R 1/42; H04R 1/44; H04R 9/046; H04R 9/06; H04R 9/025; H04R 1/023; H04R 2400/00; H04R 2499/11; H04R 2400/11

USPC ..... 181/149

See application file for complete search history.

(56) References Cited

U.S. PATENT DOCUMENTS 9,832,557 B2 * 11/2017 Park ..... H04R 1/06
9,900,703 B2 * 2/2018 Kim ..... H04R 9/043

(Continued)

FOREIGN PATENT DOCUMENTS

CN 1697566 A 11/2005
CN 102340724 A 2/2012

(Continued)

*Primary Examiner* — Forrest M Phillips

(74) *Attorney, Agent, or Firm* — Murphy, Bilak & Homiller, PLLC

(57) ABSTRACT

The present disclosure provides a reliable structure which can prevent disconnection of a voice coil lead wire, while employing a voice coil embodied as an aluminum coil to improve the mid-frequency band SPL of a slim high-pressure water resistant microspeaker. According to the present disclosure, there is provided a high-pressure water resistant microspeaker with an improved coil structure, including an FPCB attached to the outer surface of a frame, a pad of the FPCB extending inside the frame and another part of the FPCB extending outside the frame. The upper end of the voice coil is attached to an overlapping position of a side diaphragm and a center diaphragm, and the lower end of the voice coil is supported by the part of the FPCB extending inside the frame.

20 Claims, 6 Drawing Sheets

(56) References Cited

U.S. PATENT DOCUMENTS

| | | | | |
|---|---|---|---|---|
| 2005/0067216 | A1* | 3/2005 | Schuhmann | H04M 1/03 181/149 |
| 2005/0077102 | A1* | 4/2005 | Banter | H04R 1/023 181/149 |
| 2009/0242319 | A1* | 10/2009 | Stathopoulos | G08B 3/10 181/149 |
| 2017/0366888 | A1* | 12/2017 | Xiao | H04R 1/06 |
| 2018/0152800 | A1* | 5/2018 | Cai | H04R 7/122 |

FOREIGN PATENT DOCUMENTS

| | | | |
|---|---|---|---|
| CN | 102598709 | A | 7/2012 |
| CN | 104954954 | A | 9/2015 |
| CN | 205847562 | U | 12/2016 |
| KR | 101489765 | B1 | 2/2015 |
| WO | 2011155676 | A1 | 12/2011 |

* cited by examiner

HIGH-PRESSURE WATER RESISTANT MICROSPEAKER WITH IMPROVED COIL STRUCTURE

PRIORITY CLAIM

The present application claims priority to Korean Patent Application No. 10-2017-0016231 filed on 6 Feb. 2017, the content of said application incorporated herein by reference in its entirety.

TECHNICAL FIELD

The present invention relates to a high-pressure water resistant microspeaker with an improved coil structure, and more particularly, to an improved coil structure of a 3 magnet type slim high-pressure water resistant microspeaker.

BACKGROUND

Recently, as a mobile device becomes slimmer and smaller, a microspeaker mounted in the mobile device is required to be slimmer and smaller. In addition, as a wearable device becomes common together with the mobile device, it needs a waterproof function for increased convenience, and thus the microspeaker also needs the waterproof function.

FIG. 1 is an exploded perspective view showing a conventional slim high-pressure water resistant microspeaker, and FIG. 2 is a sectional view showing the conventional slim high-pressure water resistant microspeaker. The slim high-pressure water resistant microspeaker is generally formed in a rectangular shape, with a short axis having a much smaller width than a long axis. A yoke 20 is coupled to the lower side of a frame 10 having open top and bottom surfaces, and an inner magnet 21 and a pair of outer magnets 22 disposed at both sides of the inner magnet 21 are attached to the yoke 20. An inner top plate 23 corresponding to the shape of the inner magnet 21 is attached to the inner magnet 21. Meanwhile, an outer top plate 24 is attached to the pair of outer magnets 22, long-side portions of the rectangular ring-shaped outer top plate 24 being attached to the outer magnets 22, respectively. A voice coil 30 is disposed in an air gap between the inner magnet 21 and the outer magnets 22. The voice coil 30 is disposed in a floating manner not to contact the yoke 20. When a current is applied to the voice coil 30, it vibrates up and down due to a mutual electromagnetic force with a magnetic circuit composed of the yoke 20, the magnets 21 and 22 and the top plates 23 and 24 according to the signals. Electric signals are applied to the voice coil 30 by an FPCB (flexible printed circuit board) 50 attached to the outer surface of the frame 10, part of the FPCB being positioned inside the frame 10 through the frame 10.

In the meantime, the upper end portion of the voice coil 30 is attached to diaphragms 41 and 42. When the voice coil 30 vibrates up and down due to a mutual electromagnetic force with the magnetic circuit, the diaphragms 41 and 42 vibrate together, to generate sound. The diaphragms 41 and 42 include a side diaphragm 41 attached to the inner surface of the frame 10 and having a ring-shaped dome portion projecting upwardly or downwardly from its outer peripheral portion and a center diaphragm 42 attached to the center of the side diaphragm 41. That is, it can be seen that the side diaphragm 41 includes a side surface corresponding to the shape of the inner surface of the frame 10 and a vibration surface extending across the side surface and vibrated by the voice coil. Here, preferably, the side diaphragm 41 is manufactured without any perforation to increase water-tightness, and more preferably, the side surface attached to the inner surface of the frame 10 is formed as long as possible.

A grill 60 is attached to the top surface of the frame 10 and the grill 60 covers the side surface of the side diaphragm 41 to more increase water-tightness.

On the other hand, vent holes **20*h* may be formed in the yoke 20 for smooth vibration of the diaphragms 41 and 42, and screens 70 coveting the vent holes 20*h* may be attached to prevent foreign matters from entering the vent holes 20*h***.

FIG. 3 is a view showing a voice coil installation structure of the conventional slim high-pressure water resistant microspeaker. The FPCB 50 of the conventional slim high-pressure water resistant microspeaker includes a side surface 51 attached to the outer surface of the frame 10, a terminal 52 extending to the outside of the frame 10 and connected to an external circuit, and a land portion 53 inwardly extending through the frame 10. A lead wire 31 drawn to the outside of the voice coil 30 is thermally bonded to the land portion 53 and supplied with signals from the external circuit. Here, the lead wire 31 of the voice coil 30 allows the voice coil 30 to be spaced apart from the yoke 20.

In the case of the slim high-pressure water resistant microspeaker, as described above, the side surface of the side diaphragm 41 is attached to the inner surface of the frame 10 for water-tightness of the side diaphragm 41, which makes it difficult to employ a separate suspension. Accordingly, the lead wire 31 of the voice col 30 serves as the suspension. Thus, the wire used for the voice coil 30 requires a sufficient strength to support the weight of the voice coil 30, so that a copper coil should be used, not an aluminum coil. However, the copper coil is heavier than the aluminum coil, which affects the vibration of the vibration unit composed of the diaphragms 41 and 42 and the voice coil 30, thus reducing the mid-frequency band SPL (sound pressure level).

SUMMARY

An object of the present invention is to provide a reliable structure which can prevent disconnection of a voice coil lead wire, while employing a voice coil embodied as an aluminum coil to improve the mid-frequency band SPL of a slim high-pressure water resistant microspeaker.

According to an aspect of the present invention for achieving the above object, there is provided a high-pressure water resistant rnicrospeaker with an improved coil structure, including: a frame; a yoke coupled to the bottom surface of the frame; an inner magnet attached to the yoke; a pair of outer magnets attached to the yoke and disposed at both sides of the inner magnet; an inner top plate attached to the inner magnet; a rectangular ring-shaped outer top plate attached to the pair of outer magnets; a voice coil having a lower end positioned in an air gap between the inner magnet and the outer magnets; an FPCB attached to the outer surface of the frame, a part of the FPCB extending to the inside of the frame, and the other part thereof extending to the outside of the frame; a side diaphragm having a side surface attached to the inner surface of the frame and a vibration surface extending across the side surface; a center diaphragm attached to the center of the side diaphragm; and a grill attached to the top surface of the frame to cover the side surface of the side diaphragm, wherein the upper end of the voice coil is attached to an overlapping position of the side diaphragm and the center diaphragm, and the lower end of the voice coil is supported by the part of the FPCB extending to the inside of the frame.

In some embodiments, the FPCB may include a side surface attached to the outer surface of the frame, a ring-shaped support portion corresponding to the shape of the voice coil, a connection portion connecting the side surface to the support portion, and a land portion disposed at one side of the support portion.

In some embodiments, the connection portion may be bent in a U-shape after extending from the side surface and connected to the support portion.

In some embodiments, the land portion may be positioned at the opposite side to the side where the connection portion and the support portion meet.

In some embodiments, the land portion may be positioned at the U-shaped bent section of the connection portion.

In some embodiments, the voice coil may be made of copper clad aluminum (CCA).

The high-pressure water resistant microspeaker with the improved coil structure according to the present invention can improve the mid-frequency band SPL by employing an aluminum voice coil instead of a copper voice coil which is heavier.

In addition, the high-pressure water resistant microspeaker with the improved coil structure according to the present invention can improve reliability by preventing disconnection of the voice coil even when the voice coil is made of a less strong material, by replacing the lead wire (not shown) of the voice coil with the connection portion of the FPCB.

Those skilled in the art will recognize additional features and advantages upon reading the following detailed description, and upon viewing the accompanying drawings.

DETAILED DESCRIPTION

Hereinafter, a preferred embodiment of a high-pressure water resistant microspeaker with an improved coil structure according to the present invention will be described in detail with reference to the accompanying drawings.

Figure 1:
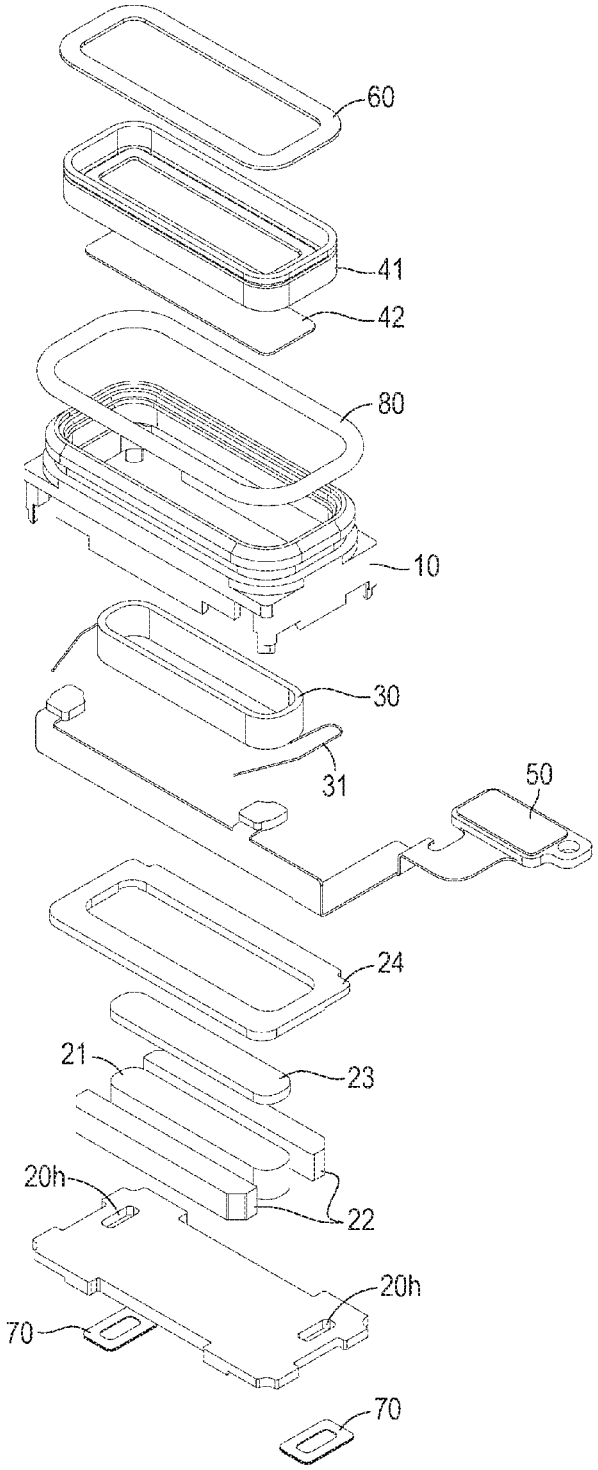
Fig. 1 (PRIOR ART)
FIG. 1 is an exploded perspective view showing a conventional slim high-pressure water resistant microspeaker.
Figure 2:
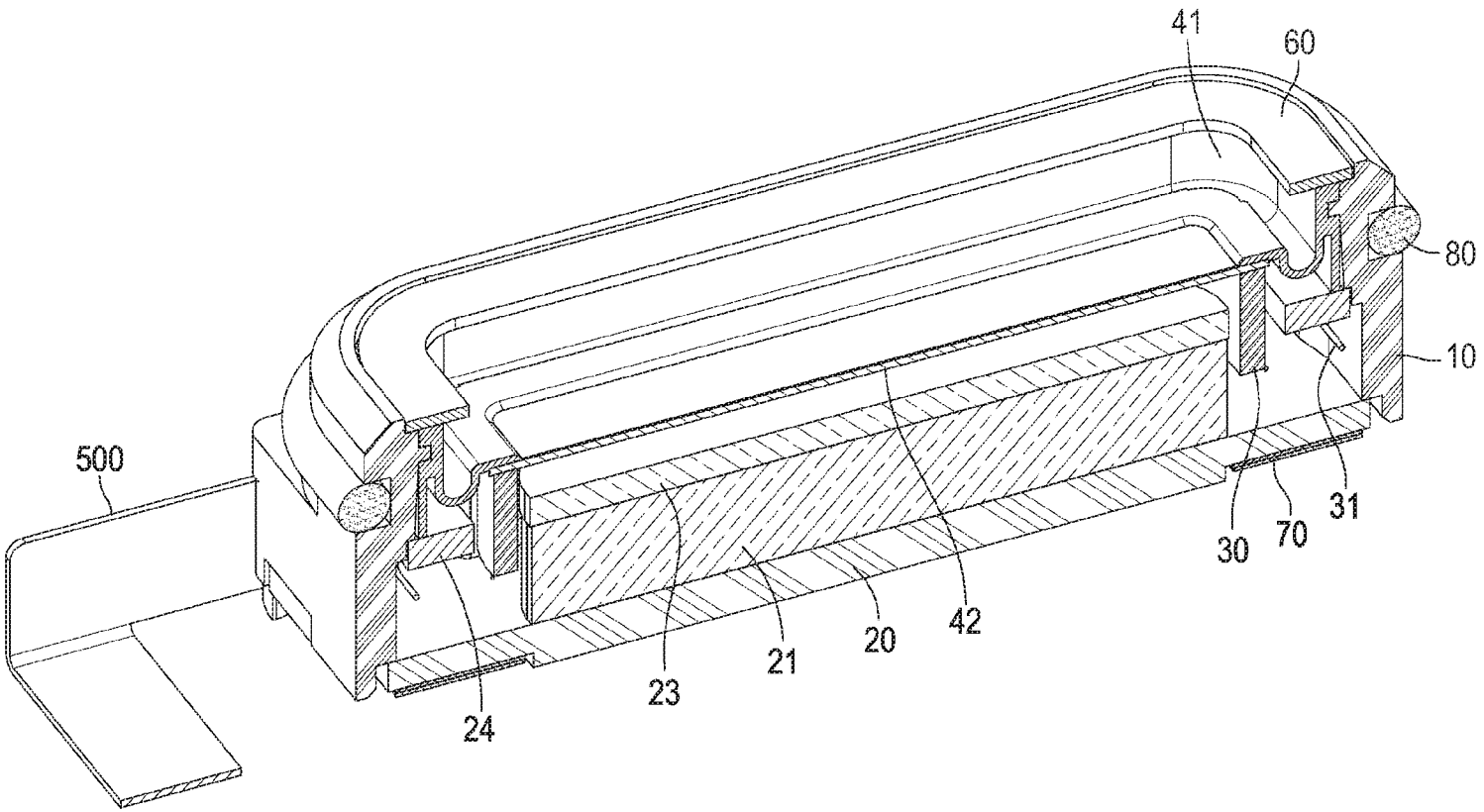
Fig. 2 (PRIOR ART)
FIG. 2 is a sectional view showing the conventional slim high-pressure water resistant microspeaker.
Figure 3:
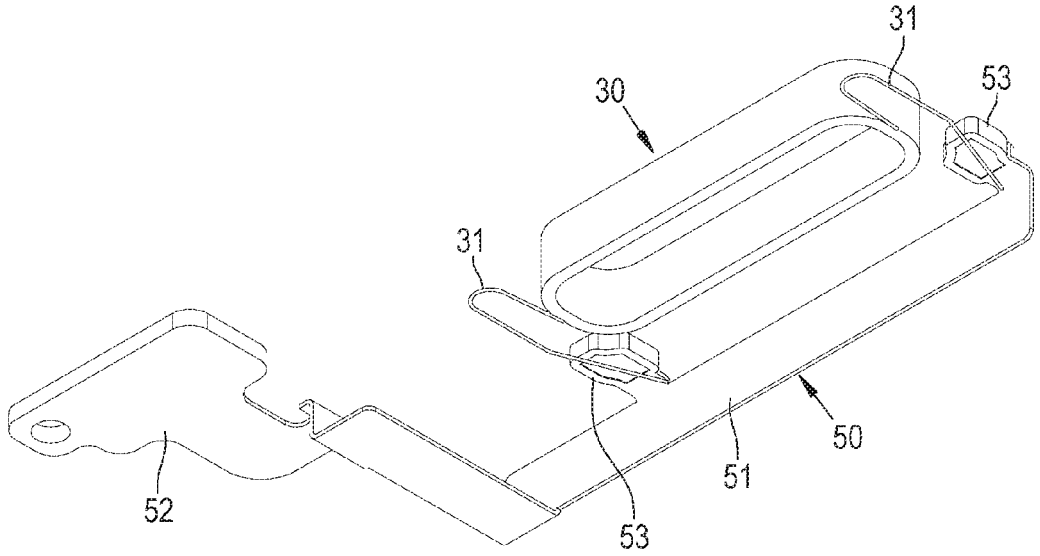
FIG. 3 is a view showing a voice coil installation structure of the conventional slim high-pressure water resistant microspeaker.
Figure 4:
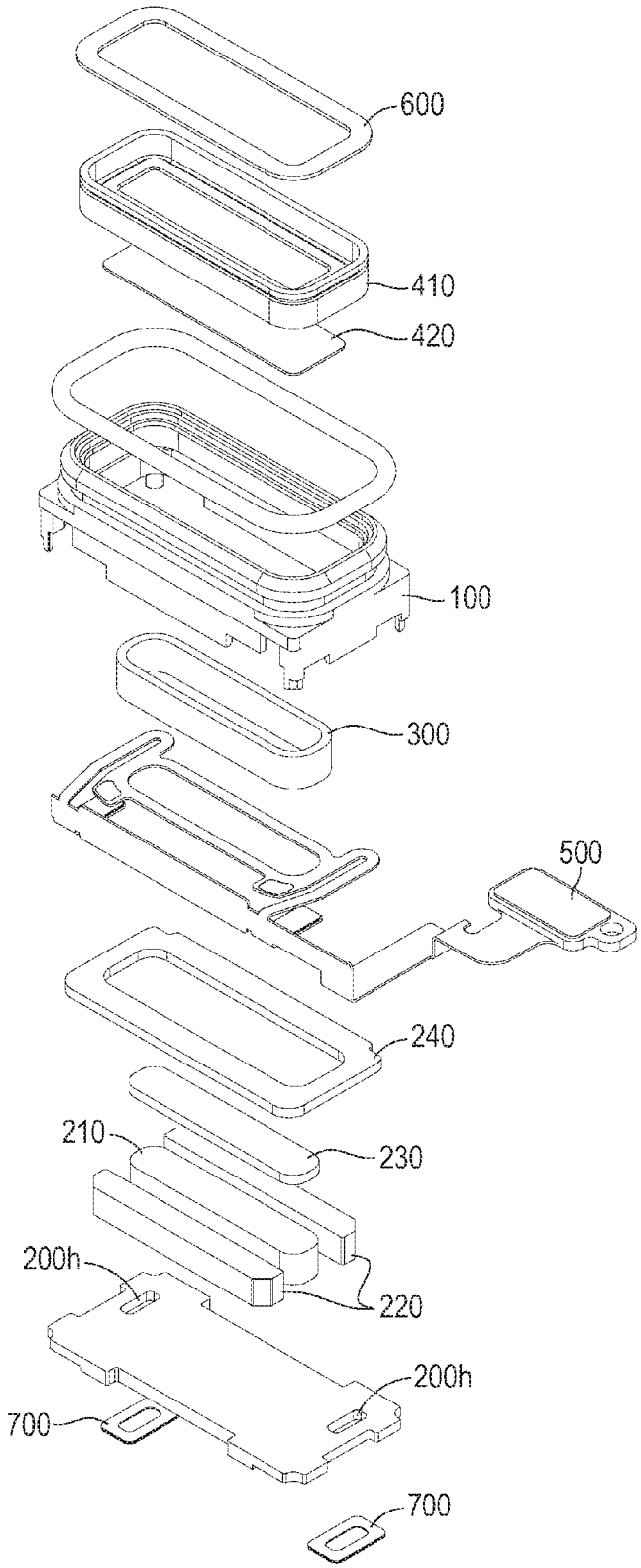
FIG. 4 is an exploded perspective view showing a slim high-pressure water resistant microspeaker according to an embodiment of the present invention.
Figure 5:
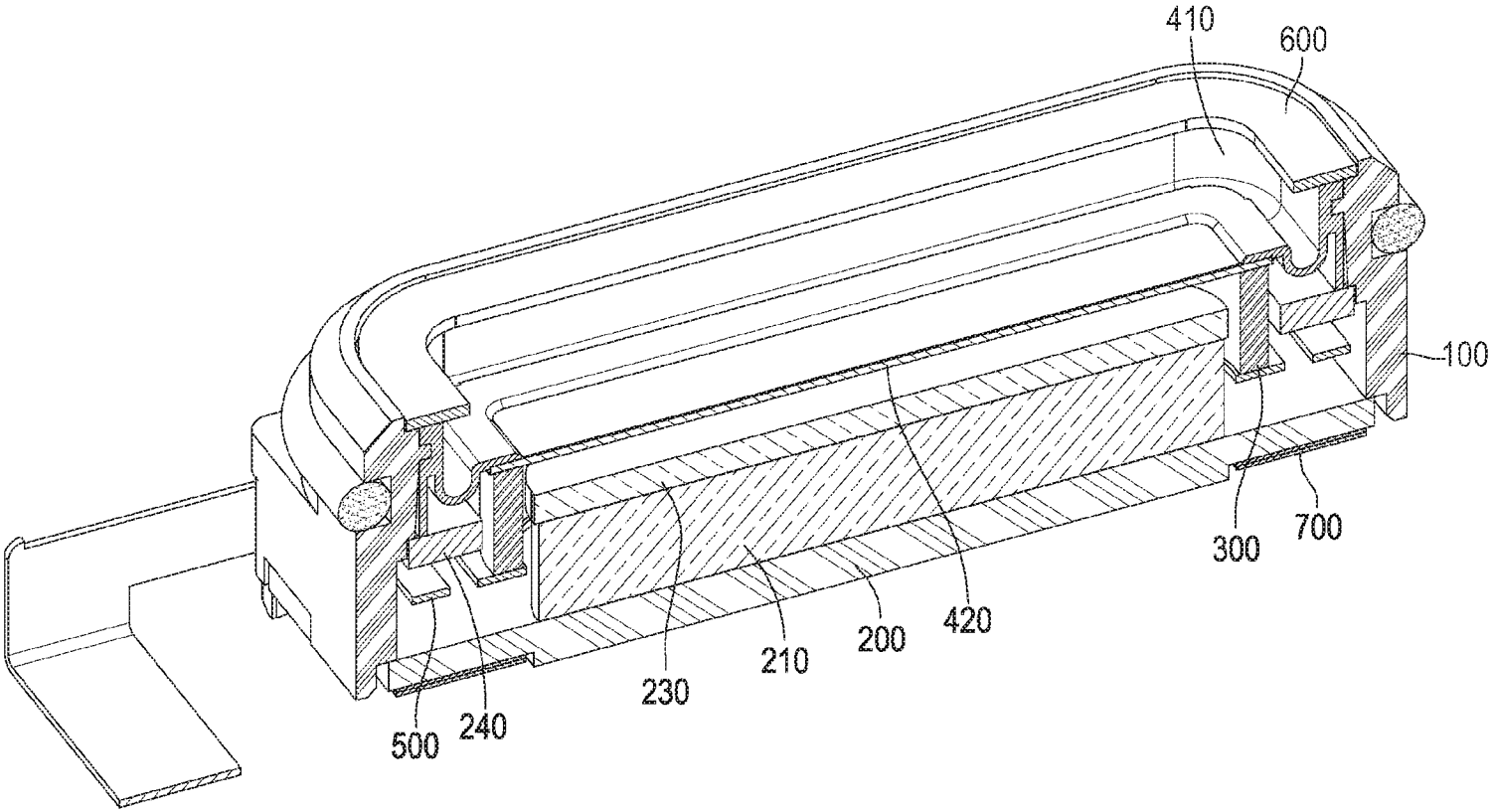
FIG. 5 is a sectional view showing the slim high-pressure water resistant microspeaker according to the embodiment of the present invention.

FIG. 4 is an exploded perspective view showing a slim high-pressure water resistant microspeaker according to an embodiment of the present invention, and FIG. 5 is a sectional view showing the slim high-pressure water resistant rnicrospeaker according to the embodiment of the present invention.

The slim high-pressure water resistant microspeaker is generally formed in a rectangular shape, with a short axis having a much smaller width than a long axis. A yoke 200 is coupled to the lower side of a frame 100 having open top and bottom surfaces, and an inner magnet 210 and a pair of outer magnets 220 disposed at both sides of the inner magnet 210 are attached to the yoke 200. An inner top plate 230 corresponding to the shape of the inner magnet 210 is attached to the inner magnet 210. Meanwhile, an outer top plate 240 is attached to the pair of outer magnets 220, long-side portions of the rectangular ring-shaped outer top plate 240 being attached to the outer magnets 220, respectively. A voice coil 300 is disposed in an air gap between the inner magnet 210 and the outer magnets 220. The voice coil 300 is disposed in a floating manner not to contact the yoke 200. When a current is applied to the voice coil 300, it vibrates up and down due to a mutual electromagnetic force with a magnetic circuit composed of the yoke 200, the magnets 210 and 220 and the top plates 230 and 240 according to the signals. Electric signals are applied to the voice coil 300 by an FPCB 500 attached to the outer surface of the frame 100, part of the FPCB 500 being positioned inside the frame 100 through the frame 100.

In the meantime, the upper end portion of the voice coil 300 is attached to diaphragms 410 and 420. When the voice coil 300 vibrates up and down due to a mutual electromagnetic force with the magnetic circuit, the diaphragms 410 and 420 vibrate together, to generate sound. The diaphragms 410 and 420 include a side diaphragm 410 attached to the inner surface of the frame 100 and having a ring-shaped dome portion projecting upwardly or downwardly from its outer peripheral portion and a center diaphragm 420 attached to the center of the side diaphragm 410. That is, it can be seen that the side diaphragm 410 includes a side surface corresponding to the shape of the inner surface of the frame 100 and a vibration surface extending across the side surface and vibrated by the voice coil. Here, preferably, the side diaphragm 410 is manufactured without any perforation to increase water-tightness, and more preferably, the side surface attached to the inner surface of the frame 100 is formed as long as possible.

A grill 600 is attached to the top surface of the frame 100 and the grill 600 covers the side surface of the side diaphragm 410 to more increase water-tightness.

On the other hand, vent holes **200*h* may be formed in the yoke 200 for smooth vibration of the diaphragms 410 and 420, and screens 700 covering the vent holes 200*h* may be attached to prevent foreign matters from entering the vent holes 200*h***.

Figure 6:
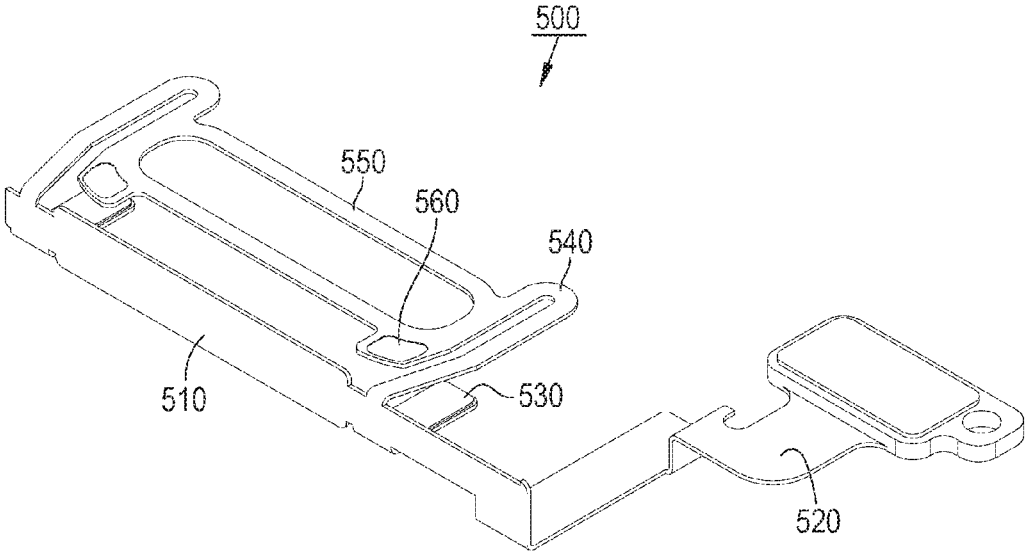
FIG. 6 is a view showing a voice coil installation structure of the slim high-pressure water resistant microspeaker according to the embodiment of the present invention.

FIG. 6 is a view showing a voice coil installation structure of the slim high-pressure water resistant microspeaker according to the embodiment of the present invention. The FPCB 500 of the slim high-pressure water resistant microspeaker according to the present invention includes a side surface 510 attached to the outer surface of the frame 100, a terminal 520 extending to the outside of the frame 100 and connected to an external circuit, a ring-shaped support portion 550 having a part inwardly extending through the frame 100, the inwardly-extending part corresponding to the shape of the voice coil 300, a connection portion 540 connecting the side surface 510 to the support portion 550, and a land portion 560 disposed at one side of the support portion 550. In addition, the FPBC 500 further includes a bottom surface 530 attached to the bottom surface of the yoke (200; see FIGS. 4 and 5) to increase attaching and supporting capacities.

In the case of the slim high-pressure water resistant microspeaker, as described above, the side surface of the side diaphragm 410 is attached to the inner surface of the frame 100 for water-tightness of the side diaphragm 410, which makes it difficult to employ a separate suspension. Accordingly, in the present invention, the support portion 550 and the connection portion 540 of the FPCB 500 serve as the suspension. The land portion 560 allows a lead wire (not shown) of the voice coil 300 to be thermally bonded thereto, so that electric signals can be applied to the voice coil 300 from the outside.

As compared with the conventional art, the lead wire (not shown) of the voice coil 300 is replaced with the connection portion 540 of the FPCB 500, which significantly reduces the possibility of disconnection of the voice coil 300. It is thus possible to eliminate rigidity restrictions in selecting a material of the voice coil 300.

Meanwhile, the connection portion 540 is extending from the side surface 510 and then bent in a U-shape and connected to the support portion 550, and the land portion 560 is positioned at the opposite side to the side where the connection portion 540 and the support portion 550 meet. The bent section of the connection portion 540 may be deformed due to the vibration of the voice coil 300. Since the land portion 560 is spaced apart from the connection portion 540, there is an advantage in reducing the possibility of crack generation in the land portion 560 or the possibility of disconnection of the lead wire (not shown) of the voice coil 300 thermally boned to the land portion 560. On the contrary, since the land portion 560 should be positioned to prevent interferences with the outer magnets 220 as well as interferences with the connection portion 540, there is a disadvantage in reducing the length of the outer magnets 220.

Figure 7:
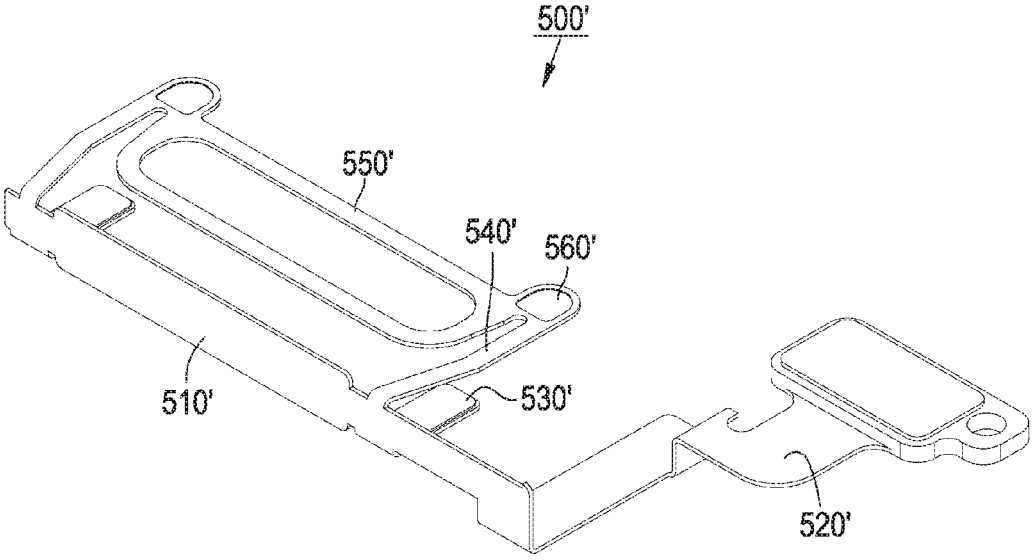
FIG. 7 is a view showing another example of the voice coil installation structure of the slim high-pressure water resistant microspeaker according to the embodiment of the present invention.

FIG. 7 is a view showing another example of the voice coil installation structure of the slim high-pressure water resistant microspeaker according to the embodiment of the present invention. The voice coil installation structure of FIG. 7 is different from that of FIG. 6 in the position of a land portion 560' of an FPCB 500'. Also in the voice coil installation structure of FIG. 7, a connection portion 540' of the FPCB 500' is bent in a U-shape after extending from a side surface 510' and connected to a support portion 550'. However, the land portion 560' is formed on the position where the connection portion 540' and the support portion 550' meet, that is to day, the U-shaped bent section of the connection portion. In this case, there is an advantage in increasing the volume of the magnet and improving the SPL, but there is a disadvantage of the possibility of crack generation in the land portion 560' or the possibility of disconnection of the lead wire of the voice coil 300 thermally boned to the land portion 560', which leads to a slightly-reduced product reliability.

On the other hand, a material of the voice coil 300 used for the slim high-pressure water resistant microspeaker according to the present invention can be selected depending on the purposes. When the voice coil 300 is made of coil, the weight of the vibration unit increases, so that the low-frequency band SPL increases but the mid-frequency band SPL decreases. Alternatively, when the voice coil 300 is made of copper clad aluminum (CCA), the weight of the vibration unit decreases, so that the mid-frequency band SPL increases but the low-frequency band SPL relatively decreases. As compared with the conventional art, the slim high-pressure water resistant microspeaker according to the present invention reduces the possibility of disconnection of the voice coil 300 by replacing the lead wire (not shown) of the voice coil 300 with the connection portion 540 of the FPCB 500. As a result, there is an advantage in freely selecting and using the material of the voice coil depending upon the importance of the low-frequency band SPL or the mid-frequency band SPL.

With the above range of variations and applications in mind, it should be understood that the present invention is not limited by the foregoing description, nor is it limited by the accompanying drawings. Instead, the present invention is limited only by the following claims and their legal equivalents.

What is claimed is:

1. A high-pressure water resistant microspeaker, comprising:

a frame;

a yoke coupled to a bottom surface of the frame;

an inner magnet attached to the yoke;

a pair of outer magnets attached to the yoke and disposed at opposite sides of the inner magnet;

an inner top plate attached to the inner magnet;

a rectangular ring-shaped outer top plate attached to the pair of outer magnets;

a voice coil having a lower end positioned in an air gap between the inner magnet and the pair of outer magnets;

an FPCB (flexible printed circuit board) including a side surface attached to an outer side surface of the frame, a part of the FPCB extending from the side surface to inside the frame, another part of the FPCB extending from the side surface to outside the frame;

a side diaphragm having a side surface attached to an inner side surface of the frame and a vibration surface extending across the side surface;

a center diaphragm attached to a center of the side diaphragm; and a grill attached to a top surface of the frame to cover the side surface of the side diaphragm, wherein an upper end of the voice coil is attached to an overlapping position of the side diaphragm and the center diaphragm, and the lower end of the voice coil is supported by the part of the FPCB extending from the side surface to inside the frame and which is configured to serve as a suspension.

2. The high-pressure water resistant microspeaker of claim 1, wherein the FPCB comprises a ring-shaped support portion corresponding to the shape of the voice coil, a connection portion connecting the side surface to the support portion, and a land portion disposed at one side of the support portion.

3. The high-pressure water resistant microspeaker of claim 2, wherein the voice coil is made of copper clad aluminum (CCA).

4. The high-pressure water resistant microspeaker of claim 2, wherein the connection portion is bent in a U-shape after extending from the side surface and connected to the support portion.

5. The high-pressure water resistant microspeaker of claim 4, wherein the voice coil is made of copper clad aluminum (CCA).

6. The high-pressure water resistant microspeaker of claim 4, wherein the land portion is positioned at an opposite side to the side which the connection portion and the support portion meet.

7. The high-pressure water resistant microspeaker of claim 6, wherein the voice coil is made of copper clad aluminum (CCA).

8. The high-pressure water resistant microspeaker of claim 4, wherein the land portion is positioned at the U-shaped bent section of the connection portion.

9. The high-pressure water resistant microspeaker of claim 8, wherein the voice coil is made of copper clad aluminum (CCA).

10. The high-pressure water resistant microspeaker of claim 1, wherein the voice coil is made of copper clad aluminum (CCA).

11. A method of manufacturing a high-pressure water resistant microspeaker, the method comprising:

coupling a yoke to a bottom surface of a frame;

attaching an inner magnet to the yoke;

attaching a pair of outer magnets to the yoke, the pair of outer magnets disposed at opposite sides of the inner magnet;

attaching an inner top plate to the inner magnet;

attaching a rectangular ring-shaped outer top plate to the pair of outer magnets;

positioning a voice coil having a lower end in an air gap between the inner magnet and the pair of outer magnets;

attaching an FPCB (flexible printed circuit board) to an outer side surface of the frame so that a part of the FPCB extends inside the frame and another part of the FPCB extends outside the frame;

attaching a side surface of a side diaphragm to an inner side surface of the frame, the side diaphragm having a vibration surface which extends across the side surface;

attaching a center diaphragm to a center of the side diaphragm;

attaching a grill to a top surface of the frame to cover the side surface of the side diaphragm;

attaching an upper end of the voice coil to an overlapping position of the side diaphragm and the center diaphragm; and supporting the lower end of the voice coil by the part of the FPCB extending inside the frame and which is configured to serve as a suspension.

12. The method of claim 11, wherein the FPCB comprises a side surface attached to the outer side surface of the frame, a ring-shaped support portion corresponding to the shape of the voice coil, a connection portion connecting the side surface to the support portion, and a land portion disposed at one side of the support portion.

13. The method of claim 12, wherein the voice coil is made of copper clad aluminum (CCA).

14. The method of claim 12, wherein the connection portion is bent in a U-shape after extending from the side surface and connected to the support portion.

15. The method of claim 14, wherein the voice coil is made of copper clad aluminum (CCA).

16. The method of claim 14, further comprising positioning the land portion at an opposite side to the side which the connection portion and the support portion meet.

17. The method of claim 16, wherein the voice coil is made of copper clad aluminum (CCA).

18. The method of claim 14, further comprising positioning the land portion at the U-shaped bent section of the connection portion.

19. The method of claim 18, wherein the voice coil is made of copper clad aluminum (CCA).

20. The method of claim 11, wherein the voice coil is made of copper clad aluminum (CCA).

* * * * *